US009151454B1

(12) United States Patent
Lindblad et al.

(10) Patent No.: US 9,151,454 B1
(45) Date of Patent: Oct. 6, 2015

(54) MODULAR LED LIGHTING APPARATUS

(71) Applicant: AUTOMATED ASSEMBLY CORPORATION, Lakeville, MN (US)

(72) Inventors: Scott Lindblad, Lakeville, MN (US); David Neuman, Randolph, MN (US); Robert Neuman, Cannon Falls, MN (US)

(73) Assignee: Automated Assembly Corporation, Lakeville, MN (US)

( * ) Notice: Subject to any disclaimer, the term of this patent is extended or adjusted under 35 U.S.C. 154(b) by 172 days.

(21) Appl. No.: 14/021,864

(22) Filed: Sep. 9, 2013

(51) Int. Cl.
*F21K 99/00* (2010.01)

(52) U.S. Cl.
CPC ..... *F21K 9/30* (2013.01)

(58) Field of Classification Search
CPC ..... F21K 9/30
USPC ..... 362/235, 236, 237
See application file for complete search history.

(56) References Cited

U.S. PATENT DOCUMENTS

| | | | | |
|---|---|---|---|---|
| 4,447,859 | A * | 5/1984 | Raczynski | 362/13 |
| 7,165,863 | B1 * | 1/2007 | Thomas et al. | 362/219 |
| 7,210,957 | B2 * | 5/2007 | Mrakovich et al. | 439/404 |
| 7,355,562 | B2 | 4/2008 | Schubert et al. | |
| 8,066,403 | B2 | 11/2011 | Sanfilippo et al. | |
| 2009/0009997 | A1 * | 1/2009 | Sanfilippo et al. | 362/244 |
| 2012/0311857 | A1 * | 12/2012 | Kampfrath et al. | 29/829 |

* cited by examiner

*Primary Examiner* — David V Bruce
(74) *Attorney, Agent, or Firm* — Crawford Maunu PLLC

(57) ABSTRACT

A lighting module is disclosed and includes a light emitting diode (LED) panel having a plurality of LEDs and two or more conductive contacts. A boxlike member has a base and sidewalls. The sidewalls have passages that provide ingress to and egress from the boxlike member for power wires. One or more mounting members are attached to the boxlike member for removably attaching the LED panel. A circuit board is disposed in the boxlike member, and the circuit board includes two or more insertion force connectors for connecting to power wires. The circuit board further includes two or more board connectors that engage the conductive contacts of the LED panel and electrically couple the conductive contacts of the LED panel to the insertion force connectors.

17 Claims, 4 Drawing Sheets

MODULAR LED LIGHTING APPARATUS

FIELD OF THE INVENTION

The disclosure generally relates to modular light-emitting diode (LED) based lighting.

BACKGROUND

LED-based lighting is becoming more popular due in part to the energy efficiency and durability of LEDs. One popular application is advertising and public information signage. As costs decrease, business and consumer use of LED lighting is expected to increase for general purpose ambient lighting.

One challenge in promoting the adoption of LED-based lighting is the myriad sizes of light fixtures. For example, tube-style fluorescent light fixtures have many different bulb sizes and numbers of bulbs. Total replacement of these types of fixtures may be prohibitively expensive. Likewise, shaping LED bulbs to mimic the bulbs being replaced may also be expensive and reduce some of the expected efficiency gains.

Approaches that address these and other related issues are therefore desirable.

SUMMARY

According to one embodiment a lighting module includes a light emitting diode (LED) panel having a plurality of LEDs and two or more conductive contacts. A boxlike member has a base and sidewalls. The sidewalls have passages that provide ingress to and egress from the boxlike member for power wires. One or more mounting members are attached to the boxlike member for removably attaching the LED panel. A circuit board is disposed in the boxlike member, and the circuit board includes two or more insertion force connectors for connecting to power wires. The circuit board further includes two or more board connectors that engage the conductive contacts of the LED panel and electrically couple the conductive contacts of the LED panel to the insertion force connectors.

In another embodiment, a modular lighting apparatus includes a plurality of lighting modules. Each lighting module includes a light emitting diode (LED) panel having a plurality of LEDs and two or more conductive contacts. A boxlike member has a base and sidewalls. The sidewalls have passages that provide ingress to and egress from the boxlike member for power wires. One or more mounting members are attached to the boxlike member for removably attaching the LED panel. A circuit board is disposed in the boxlike member, and the circuit board includes two or more insertion force connectors for connecting to power wires. The circuit board further includes two or more board connectors that engage the conductive contacts of the LED panel and electrically couple the conductive contacts of the LED panel to the insertion force connectors. A plurality of expansion connectors connect the lighting modules. Each expansion connector has a first side removably engaged with the LED panel of one of the lighting modules and a second side removably engaged with a side of a boxlike member of another of the lighting modules.

The above summary of the present invention is not intended to describe each disclosed embodiment of the present invention. The figures and detailed description that follow provide additional example embodiments and aspects of the present invention.

BRIEF DESCRIPTION OF THE DRAWINGS

Other aspects and advantages of the invention will become apparent upon review of the Detailed Description and upon reference to the drawings in which.

DETAILED DESCRIPTION

The disclosed LED lighting modules may be used in customized lighting applications or may be used in retrofitting or replacing overhead lighting arrangements. In one implementation, a lighting module includes a light emitting diode (LED) panel, a boxlike member, and a circuit board. The LED panel includes a plurality of LEDs and two or more conductive contacts for providing power to the LEDs. The LED panel may have additional conductive contacts for signals to control the LEDs for dimming, flashing, or to achieve other effects. The circuit board is disposed in the boxlike member, and the LED panel is removably attached to the boxlike member. The circuit board has board connectors that engage the conductive contacts of the LED panel and electrically couple the conductive contacts of the LED panel to insertion force connectors that are disposed on the circuit board. The insertion force connectors provide terminals for connecting power wires and optionally, control wires. The boxlike member has passages that provide ingress to and egress from the boxlike member for power and optional control wires. The boxlike member may be attached to a support structure, such as rafters or studs in a building, or to the housing of an existing light fixture. The features of the boxlike member, LED panel, and circuit board provide convenient on-site installation, assembly, and customization for a variety of lighting applications.

Figure 1:
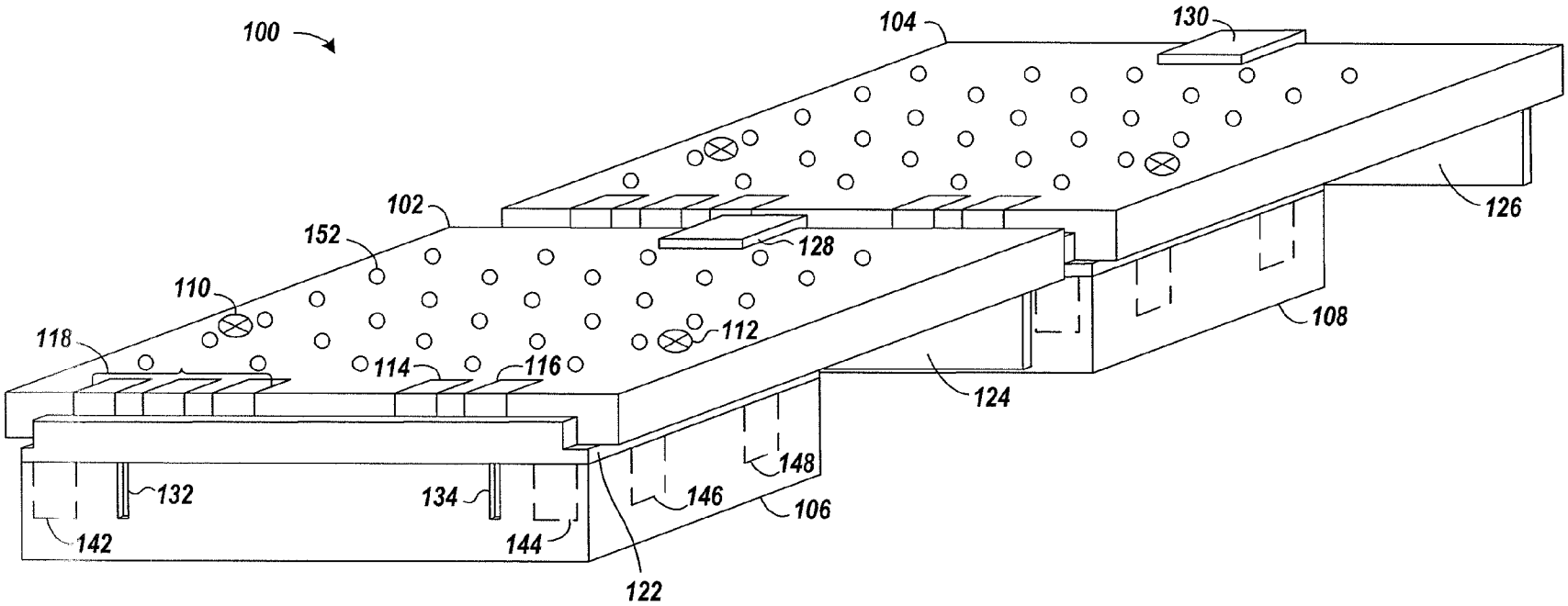
FIG. 1 shows a perspective view of an LED lighting arrangement in which two LED modules are connected.

FIG. 1 shows a perspective view of an LED lighting arrangement 100 in which two LED modules are connected. The connected modules show how the modules can be combined to construct a lighting arrangement of the desired size. A single module may be suitable for some applications. In other applications, for example, some number of modules may be connected to replicate the lighting provided by multiple fluorescent tubes. Multiple rows of connected LED modules may be combined for even greater light output. The number of modules used in an application depends on the lighting requirements, the light output level of each module, and power limitations.

Each module includes an LED panel, a boxlike member, and a circuit board (not shown). For example one module includes LED panel 102 and boxlike member 106, and another module includes LED panel 104 and boxlike member 108. Each module may further include a cover for compliance with regulatory requirements. For example, the module having LED panel 102 includes cover 122, which covers an open side of boxlike member 106.

Each of the LED panels 102 and 104 is removably attached to a respective one of boxlike members 106 and 108. In an example implementation, each LED panel may be secured to the respective boxlike member with screws that engage posts (not shown) within the boxlike member. For example, screws 110 and 112 engage posts within boxlike member 106.

Each LED panel further includes conductive contacts for providing power and optionally, control signals, to the LED panel. LED panel 102 has conductive contacts 114 and 116 for providing power. Contacts 118 are optional for providing control signals. In an example implementation, the conductive contacts are blade connectors, and the blades of the conductive contacts extend through the cover. For example, the blades of conductive contacts 114, 116, and 118 extend through cover 122 and connect to a circuit board (not shown) that is disposed within the boxlike member 106.

Each module may further include an expansion connector. The expansion connector stabilizes the LED panel of the module and promotes even spacing between modules for multi-module applications. Expansion connectors 124 and 126 are shown for the two modules. Further details of the expansion connectors are shown in the ensuing figures. Each expansion connector has a first side that is removably engaged with the LED panel and a second side for removably engaging a side of a boxlike member of another lighting module. For example, expansion connector 124 is removably engaged with LED panel 102 and removably engaged with boxlike member 108. Expansion connector 126 is removably engaged with LED panel 104 and provides support for the LED panel at the end opposite the end supported by the boxlike member 108. Tabs 128 and 130 are elements of expansion connectors 124 and 126, respectively. Additional tabs (not shown) of the expansion connectors 124 and 126 engage the hidden sides of the LED panels 102 and 104. Each boxlike member includes slots for engaging an expansion connector. For example, boxlike member 106 has slots 132 and 134.

Each boxlike member further includes passages for providing ingress to and egress from the boxlike member for wiring. In an example implementation, the passages may be provided by knock-outs in side walls of the boxlike member. For example, boxlike member 106 is shown with knockouts 142, 144, 146, and 148.

The number and pattern of LEDs on the LED panel may vary according to application requirements. For example, in one implementation, the LEDs are evenly spaced on the panel, and the spacing between LEDs on the panel is made to equal the space between an LED on the panel and the immediately adjacent (i.e., same row or column) LED on the panel of a connected module. In one implementation, the LEDs are surface mounted on the panel. The LEDs in lighting arrangement 100 are shown as small circles, such as circle 152. It will be appreciated that the LED panel could be an edge-lit panel depending on application requirements.

Figure 2:
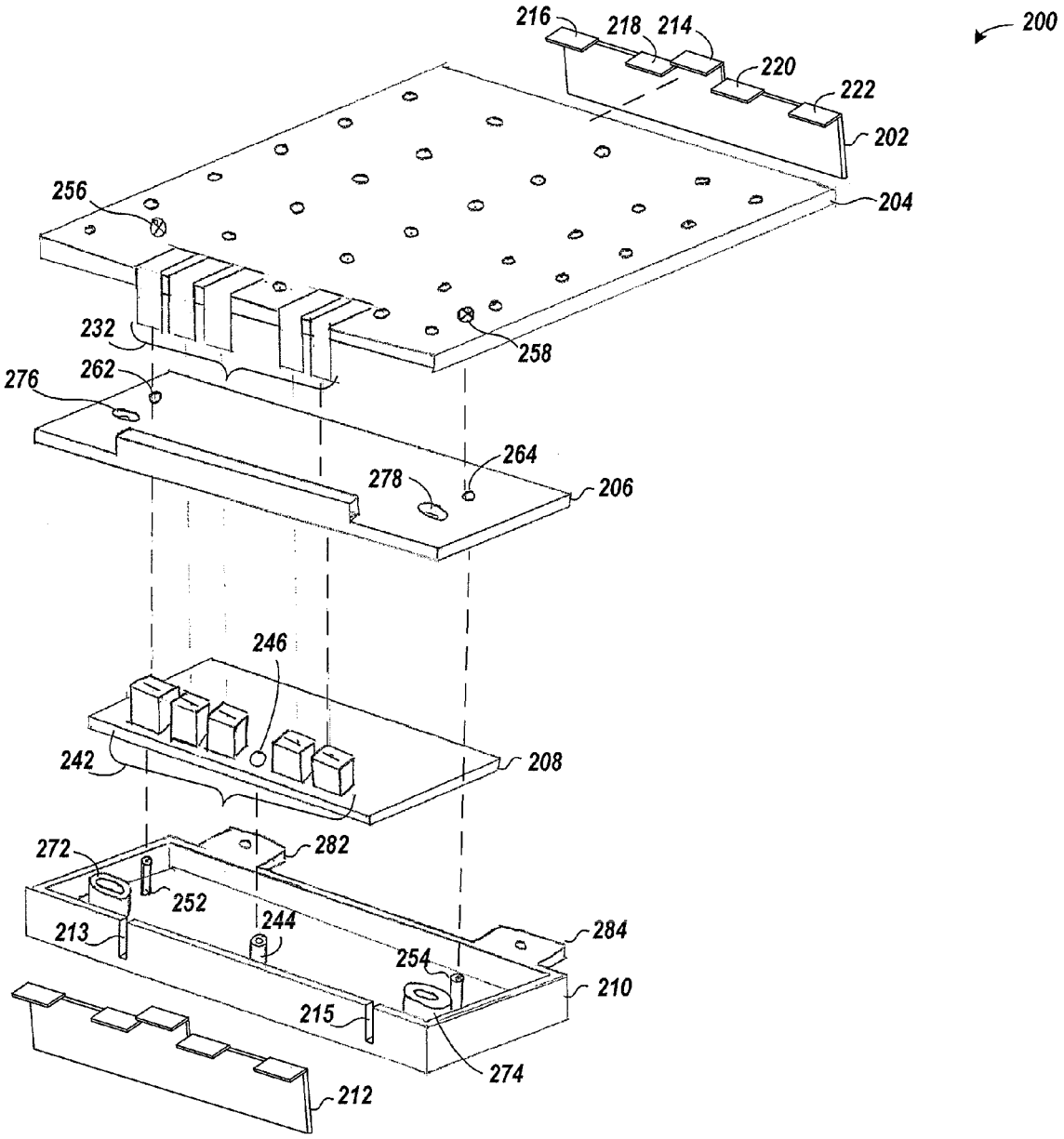
FIG. 2 shows an exploded view of a lighting module.

FIG. 2 shows an exploded view of a lighting module 200. The lighting module includes expansion connector 202, LED panel 204, cover 206, circuit board 208, and boxlike member 210. Expansion connector 212 is shown to illustrate that another lighting module can be attached to the boxlike member 210 of lighting module 200. Boxlike member 210 has slots 213 and 215 into which extensions (not shown) on the box-facing side of the expansion connector 212 may be slid for attaching the connector 212 to the boxlike member 210.

Expansion connector 202 has multiple tabs for engaging the LED panel 204. The expansion connector is configured with tab 214 that engages the light-emitting surface of the LED panel and tabs 216, 218, 220, and 222 that engage the opposing side of the LED panel.

In one implementation, the LED panel 204 includes a flexible substrate (not separately shown) having multiple surface mounted LEDs. A lens (not shown) may be disposed over the array of LEDs, and an aluminum sheet (not separately shown) may be attached to the substrate to provide heat dissipation. Depending on application requirements, the lens may be clear or opaque acrylic, for example. It will be recognized that the substrate may be flexible or rigid.

The conductive contacts of the LED panel are blade connectors in one implementation. The blade connectors extend through cover 206 and are electrically and mechanically connected to the board connectors 242. In an alternative implementation, the conductive contacts of the LED panel may be surface contacts (not shown) and the circuit board 208 may have spring clips (not shown) for engaging the surface contacts and LED panel. In yet another implementation, a card edge connector may be used to connect the LED panel and circuit board 208.

Circuit board 208 is disposed in boxlike member 210. The circuit board includes at least two board connectors 242 that engage the conductive contacts 232 of the LED panel. The board connectors electrically couple the conductive contacts of the LED panel to power distribution and control circuitry (not shown) on the circuit board. The circuit board further includes two or more insertion force connectors for connecting to external power and optional control wires, as shown in subsequent figures. Guidepost 244, which is attached to the boxlike member 210 and hole 246 in the circuit board serve to properly position the circuit board within the boxlike member.

The boxlike member 210 has mounting members 252 and 254 attached thereto for attaching the LED panel 204 and cover 206 to the boxlike member. In the example implementation, the mounting members are posts integrated with the base of the boxlike member. The posts have hollow centers to engage screws or bolts that pass through the LED panel and cover. For example, the LED panel and cover may be secured to the boxlike member by screws passing through holes 256 and 258 in the LED panel and holes 262 and 264 in the cover and engaging mounting members 252 and 254 in the boxlike member.

The boxlike member 210 may further include two or more integrated support posts for securing the boxlike member to an external structure. For example, boxlike member 210 has support posts 272 and 274 attached to the base. The boxlike member may be attached to the external support structure with screws through the support posts. Screws through openings 276 and 278 in the cover may be used to secure the cover to the boxlike member and the boxlike member to an external structure. Supports 282 and 284 are also integrated with the boxlike member and may alternatively be used for attaching the boxlike member to an external structure.

Figure 3:
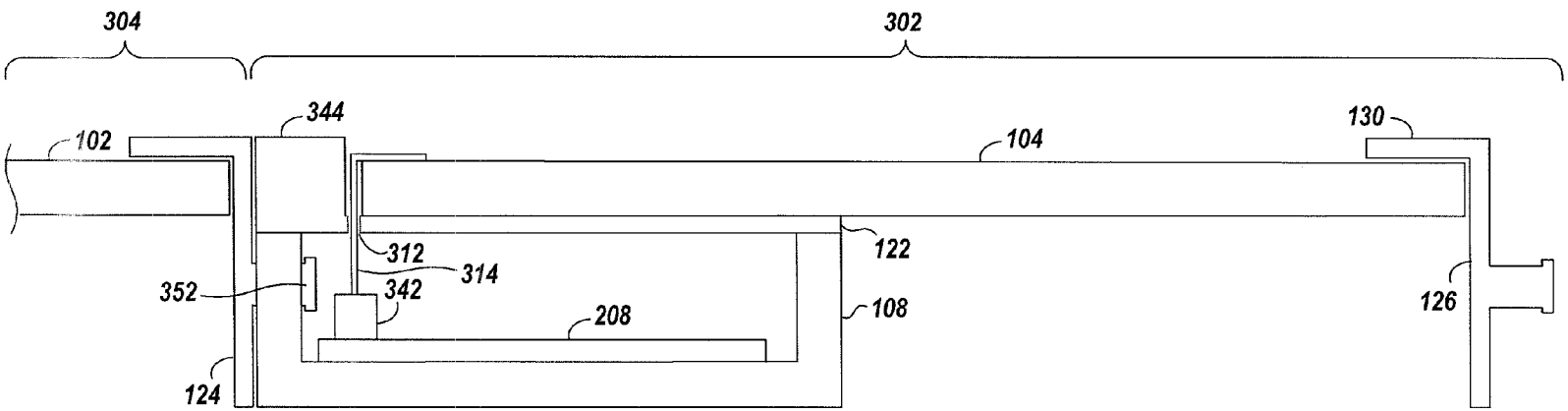
FIG. 3 shows a cross-sectional view of a first lighting module and a portion of another lighting module, which is connected to the first lighting module.

FIG. 3 shows a cross-sectional view of a first lighting module 302 and a portion of another lighting module 304, which is connected to the first lighting module. Reference numbers for elements of FIGS. 1 and 2 are used for corresponding elements in FIG. 3. For ease of illustration, some elements, such as the LEDs from FIG. 1, are not shown in FIG. 3.

The circuit board 208 is disposed within the boxlike member 108. The cover 122 covers the opening of the boxlike member and has an opening 312 through which the conductive contacts (e.g., blade connectors) of the LED panel pass and connect to the board connector on the printed circuit board. For example, the blade connector 314 passes through the opening and is mechanically and electrically engaged with the board connector 342. The raised portion 344 on the cover 122 helps protect the blade connector 314 and to guide the LED panel 104 into place for assembly of the module.

Expansion connector 124 engages the boxlike member 108 with portion 352, which extends through an opening in the boxlike member 108. An example of the referenced opening is the slot 134 of boxlike member 106 as shown in FIG. 1. Expansion connector 126 engages the end of the LED panel 104 that is opposite the end of the panel that is supported by the boxlike member 108. Expansion connector 126 may be useful for supporting the LED panel in assemblies in which module 302 is the first/last module in a line of modules.

Figure 4:
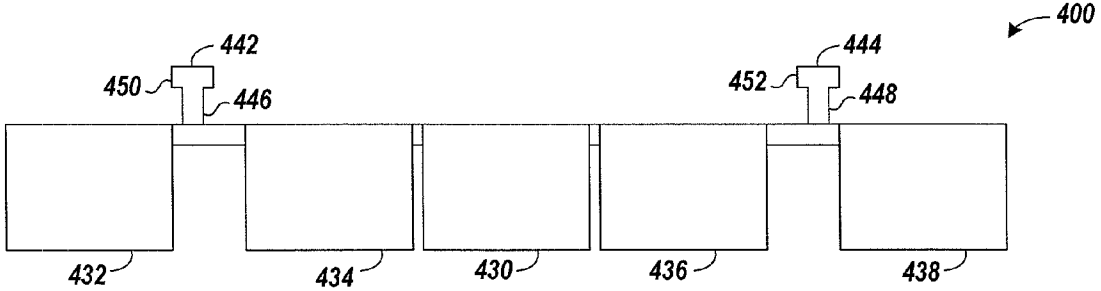
FIG. 4 is a top view of an expansion connector.

FIG. 4 is a top view of an expansion connector 400. Top refers to the side of the expansion connector that would be visible with the connector oriented as it would be if engaged with an LED panel with the light-emitting side of the LED panel being visible.

Tab 430 engages the light-emitting side of an LED panel, and tabs 432, 434, 436, and 438 engage the side opposite the light-emitting side of the LED panel.

Extensions 442 and 444 are integral portions of the expansion connector 400 and are for attaching the connector to a boxlike member. The expansion connector may be attached to a boxlike member by aligning the extensions 442 and 444 with the corresponding openings (e.g., 132 and 134 in FIG. 1) in the boxlike member such that portions 446 and 448 are above the openings, and portions 450 and 452 are over the cavity of the boxlike member, and sliding the expansion connector downward such that the portions 446 and 448 extend through the openings. The portions 450 and 452, which are wider than the openings and are within the cavity of the boxlike member, prevent separation of the connector and the boxlike member in a direction other than the direction by which the connector was attached to the boxlike member.

Figure 5:
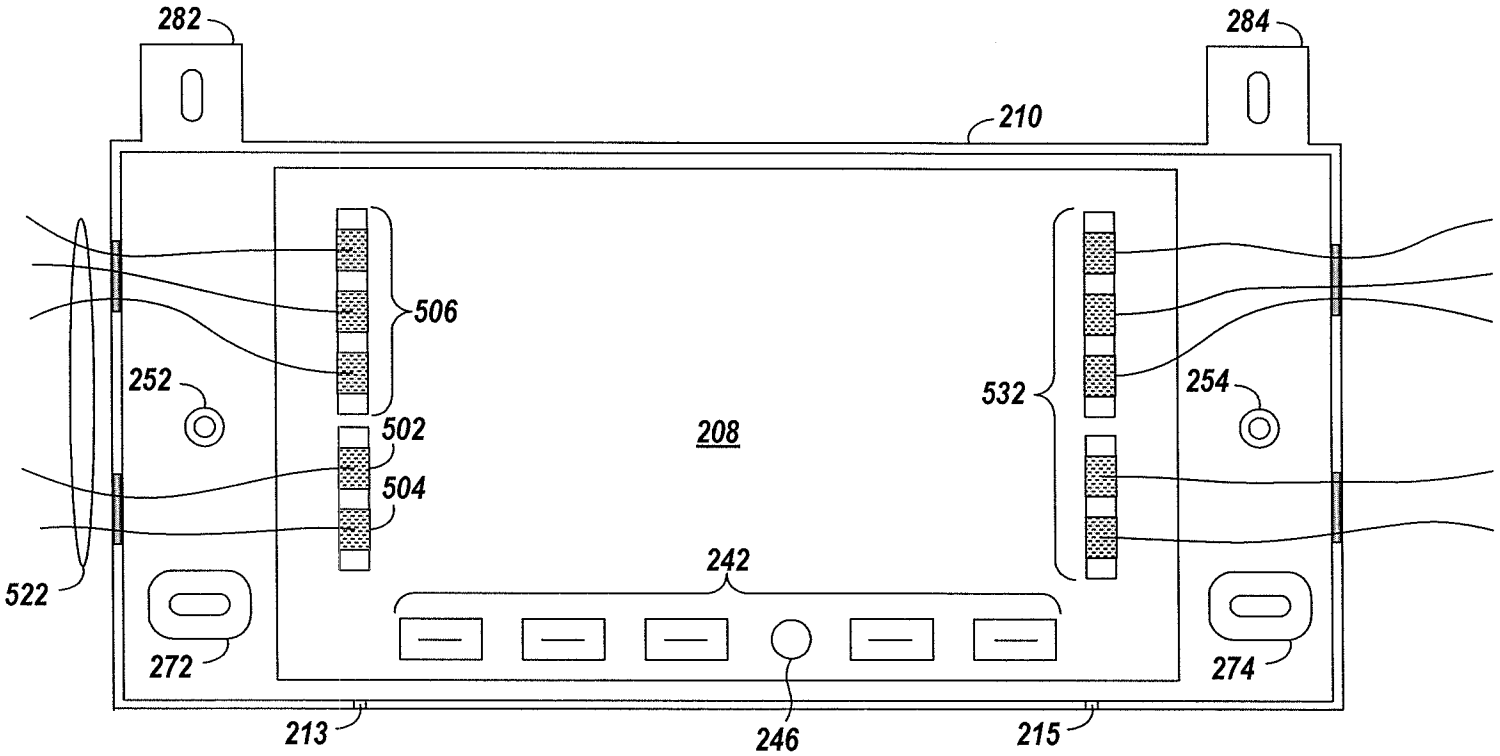
FIG. 5 shows a plan view of a circuit board disposed within a boxlike member.

FIG. 5 shows a plan view of a circuit board disposed within a boxlike member. Reference numbers for elements of FIG. 2 are used for corresponding elements in FIG. 5.

The circuit board 208 includes insertion force connectors for providing power and optionally, control signals, to the circuit board. For example, insertion force connectors 502 and 504 are included to provide power terminals for the circuit board. Additional insertion force connectors 506 may be included for connecting control signals to the circuit board. In one implementation, the insertion force connectors are push-in connectors. With a push-in connector, a bare conductive end of a wire is inserted to the connector to establish an electrical connection. In another implementation, the insertion force connectors are insulation displacement connectors. With an insulation displacement connector an insulated wire may be forced into the connector, with the connector cutting and displacing the insulation in order to make an electrical connection. Curved lines 522 represent the power and signal wires to the circuit board. An additional bank of insertion force connectors 532 may be included depending on implementation requirements. The insertion force connectors may be used to electrically connect one lighting module to another for providing power and control.

The present invention is thought to be applicable to a variety of lighting applications. Other aspects and embodiments will be apparent to those skilled in the art from consideration of the implementations disclosed herein. It is intended that the specification and illustrated implementations be considered as examples only, with a true scope of the invention being indicated by the following claims.

We claim:

1. A lighting module, comprising:

a light emitting diode (LED) panel including a plurality of LEDs and two or more conductive contacts;

a boxlike member having a base and sidewalls, the sidewalls having passages that provide ingress to and egress from the boxlike member for power wires;

one or more mounting members attached to the boxlike member and to which the LED panel is removably attached; and a circuit board disposed in the boxlike member, the circuit board including:

two or more insertion force connectors for connecting to power wires; and two or more board connectors that engage the conductive contacts of the LED panel and electrically couple the conductive contacts of the LED panel to the insertion force connectors.

2. The lighting module of claim 1, further comprising an expansion connector having a first side removably engaged with the LED panel and a second side for removably engaging a side of a boxlike member of another lighting module.

3. The lighting module of claim 1, wherein the two or more insertion force connectors are push-in connectors.

4. The lighting module of claim 1, wherein the two or more insertion force connectors are insulation displacement connectors.

5. The lighting module of claim 1, wherein the conductive contacts of the LED panel are blade connectors.

6. The lighting module of claim 1, further comprising a removable cover disposed on the boxlike member and between the circuit board and the LED panel.

7. The lighting module of claim 6, wherein the conductive contacts of the LED panel are blade connectors, and the blade connectors extend through the cover.

8. The lighting module of claim 1, further comprising a plurality of support posts attached to the boxlike member for securing the boxlike member to an external structure.

9. The lighting module of claim 1, wherein the LED panel includes:

an aluminum sheet;

a flexible substrate attached to the aluminum sheet and having the plurality of LEDs disposed thereon; and a lens disposed over the plurality of LEDs.

10. A modular lighting apparatus, comprising:

a plurality of lighting modules, each lighting module including:

a light emitting diode (LED) panel including a plurality of LEDs and two or more conductive contacts;

a boxlike member having a base and sidewalls, the sidewalls having passages that provide ingress to and egress from the boxlike member for power wires;

one or more mounting members attached to the boxlike member and to which the LED panel is removably attached; and a circuit board disposed in the boxlike member, the circuit board including:

two or more insertion force connectors for connecting to power wires; and two or more board connectors that engage the conductive contacts of the LED panel and electrically couple the conductive contacts of the LED panel to the insertion force connectors; and a plurality of expansion connectors, each expansion connector having a first side removably engaged with the LED panel of one of the lighting modules and a second side removably engaged with a side of a boxlike member of another of the lighting modules.

11. The lighting apparatus of claim 10, wherein the two or more insertion force connectors are push-in connectors.

12. The lighting apparatus of claim 10, wherein the two or more insertion force connectors are insulation displacement connectors.

13. The lighting apparatus of claim 10, wherein the conductive contacts of the LED panel are blade connectors.

14. The lighting apparatus of claim 10, wherein each lighting module further includes a removable cover disposed on the boxlike member and between the circuit board and the LED panel.

15. The lighting apparatus of claim 14, wherein the conductive contacts of the LED panel are blade connectors, and the blade connectors extend through the cover.

16. The lighting apparatus of claim 10, wherein the boxlike member further includes a plurality of support posts for securing the boxlike member to an external structure.

17. The lighting apparatus of claim 10, wherein the LED panel includes:

an aluminum sheet;

a flexible substrate attached to the aluminum sheet and having the plurality of LEDs disposed thereon; and a lens disposed over the plurality of LEDs.

* * * * *